US008108972B2

(12) United States Patent
Bae et al.

(10) Patent No.: US 8,108,972 B2
(45) Date of Patent: Feb. 7, 2012

(54) DOOR HANDLE FOR REFRIGERATOR

(75) Inventors: Sung-Wook Bae, Jinju (KR); Jong-Hyeok An, Changwon (KR); Hyeon-Po Cho, Busan (KR); Chang-Bong Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 461 days.

(21) Appl. No.: 12/066,047

(22) PCT Filed: Sep. 7, 2006

(86) PCT No.: PCT/KR2006/003566

§ 371 (c)(1), (2), (4) Date: Mar. 6, 2008

(87) PCT Pub. No.: WO2007/029978

PCT Pub. Date: Mar. 15, 2007

(65) Prior Publication Data

US 2008/0244869 A1 Oct. 9, 2008

(30) Foreign Application Priority Data

Sep. 7, 2005 (KR) ..... 10-2005-0083436
Oct. 24, 2005 (KR) ..... 10-2005-0100414
Dec. 28, 2005 (KR) ..... 10-2005-0132044
Mar. 28, 2006 (KR) ..... 10-2006-0028071

(51) Int. Cl.
*A47B 95/02* (2006.01)

(52) U.S. Cl. ..... 16/412; 16/413

(58) Field of Classification Search ..... 16/412, 16/110.1, 111.1, 113.1, 407, 413, 415, 416, 16/422, 425, DIG. 18, DIG. 19, DIG. 24; 312/348.6, 332.1

See application file for complete search history.

(56) References Cited

U.S. PATENT DOCUMENTS

| | | | | |
|---|---|---|---|---|
| 1,993,938 | A * | 3/1935 | McDonald | 16/111.1 |
| 2,407,763 | A * | 9/1946 | North et al. | 16/419 |
| 3,187,859 | A * | 6/1965 | Maziarka | 190/116 |
| 3,270,454 | A * | 9/1966 | Lachance | 40/308 |
| 3,766,598 | A * | 10/1973 | Roberts | 16/444 |
| 4,087,141 | A * | 5/1978 | Roberts | 312/348.6 |
| 4,745,656 | A * | 5/1988 | Revlett | 16/412 |
| 5,025,352 | A * | 6/1991 | Brown | 362/501 |
| 5,487,203 | A * | 1/1996 | Brach et al. | 15/245 |
| 5,810,372 | A * | 9/1998 | Arendt | 280/33.992 |
| 6,903,882 | B1 * | 6/2005 | Cameron et al. | 359/803 |
| 2004/0205916 | A1 * | 10/2004 | Byun | 15/143.1 |
| 2008/0053771 | A1 * | 3/2008 | Wu | 190/115 |

FOREIGN PATENT DOCUMENTS

JP 55-067017 U 5/1980

(Continued)

*Primary Examiner* — Victor Batson
*Assistant Examiner* — Jeffrey O Brien
(74) *Attorney, Agent, or Firm* — Birch, Stewart, Kolasch & Birch, LLP

(57) ABSTRACT

A decoration is installed in a seating channel provided in a handle bar. The seating channel with the decoration installed therein is shielded by a transparent or translucent handle cover. Cover end coupling pieces are provided at both ends of the handle cover and coupled with coupling ribs of a handle bar body of the handle bar or a cover base. The cover end coupling pieces protrude and extend from both ends of the handle cover to be perpendicular to other portions. A luminous body or jewel may be used as the decoration.

11 Claims, 11 Drawing Sheets

FOREIGN PATENT DOCUMENTS

| | | | |
|---|---|---|---|
| JP | 62-171789 | U | 10/1987 |
| KR | 10-2003-0055915 | B1 | 10/1987 |
| KR | 10-1999-0027380 | U | 6/1999 |
| KR | 20-1999-0027380 | U | 7/1999 |
| KR | 20-0239616 | Y1 | 9/1999 |
| KR | 10-2003-0055915 | B1 | 7/2003 |

* cited by examiner

DOOR HANDLE FOR REFRIGERATOR

TECHNICAL FIELD

The present invention relates to a refrigerator, and more particularly, to a door handle for a refrigerator, which is used for opening or closing a door that opens or closes a storage space in the refrigerator.

BACKGROUND ART

The configuration of a refrigerator mounted with a conventional door handle will be described with reference to FIG. 1. A storage space 3 is formed inside a refrigerator main body 1. The storage space 3 may be partitioned into a refrigerating chamber and a freezing chamber, which are located at upper and lower portions of the main body 1, respectively. A pair of refrigerating chamber doors 5 for selectively opening or closing the refrigerating chamber are provided at both ends of a front face of the upper portion of the main body 1, and a freezing chamber door 7 for selectively opening or closing the freezing chamber is installed at a front face of the lower portion of the main body 1.

Door handles 5' and 7' are installed on the refrigerating chamber doors 5 and the freezing chamber door 7, respectively. The door handles 5' and 7' are constructed such that handle holders 6' and 8' supporting both ends of each of handle bars 6 and 8 are fixed to the doors 5 and 7, respectively. The both ends of each of the handle bars 6 and 8 are inserted into and fixed to the handle holders 6' and 8'.

The handle bars 6 and 8 may comprise main bodies 6*a* and 8*a* constituting the bodies of the handle bars 6 and 8, and decorations 6*b* and 8*b* for decorating front faces, respectively. In this case, the main bodies 6*a* and 8*a* are generally made of a metallic material such as aluminum, and the decorations 6*b* and 8*b* are generally made of a material such as plastics.

However, the conventional door handle described above has the following problems.

First, each of the handle bars 6 of the conventional door handles 5' and 7' is an elongated single bar. Thus, when a user grips and pulls the handle bars 6 with his/her hand, the handle bars 6 are repeatedly deformed and restored due to their elastic deformation. Thus, during use, coupling between the handle bars 6 and the handle holders 6' and 8' may be loosed so that the handle bars 6 come off or are shaken, which may cause a problem of inconvenience to the user.

In addition, since the main bodies 6*a* and 8*a* and the decorations 6*b* and 8*b* of the handle bars 6 are made of different materials, i.e., metal and plastics, they have different coefficients of thermal expansion. Thus, the main bodies 6*a* and 8*a* and the decorations 6*b* and 8*b* are expanded or contracted at different rates according to changes in indoor temperature, which may cause separation between them. Particularly, in a case where the handle bars 6 are assembled at a low temperature and used at a high temperature, the main bodies 6*a* and 8*a* made of a metallic material sensitive to thermal changes are expanded longer. Therefore, the main bodies 6*a* and 8*a* raise the handle holders 6' and 8', thereby causing a problem in that the decorations 6*b* and 8*b* relatively insensitive to thermal changes are separated or shaken.

In addition, since the handle bars 6 and 8 in the prior art are constructed such that the decorations 6*b* and 8*b* are simply mounted on the main bodies 6*a* and 8*a*, there is a problem in that it is not possible to meet desires of users who want a variety of designs.

The handle bars 6 and 8 in the prior art function only as parts that are gripped and pulled by a user to open or close the doors 5 and 7. However, since the user cannot see the handle bars 6 and 8 when intending to open or close the doors of the refrigerator in a dark state, for example at night, the user should turn on an additional lamp and then grip the handle bars 6 and 8 to open or close the doors 5 and 7.

DISCLOSURE

Technical Problem

Accordingly, the present invention is conceived to solve the aforementioned problems in the prior art. An object of the present invention is to provide a door handle with relatively enhanced strength.

Another object of the present invention is to provide a door handle that can be variously decorated.

A further object of the present invention is to provide a door handle of which components are firmly coupled to one another.

A still further object of the present invention is to diversify an appearance of a front face of a door handle.

A still further object of the present invention is to manufacture various kinds of door handles with minimized design changes of components.

A still further object of the present invention is to provide a door handle that can be easily identified even in the dark by mounting a luminous body therein.

Technical Solution

According to an aspect of the present invention for achieving the objects, there is provided a door handle for a refrigerator, comprising a handle bar having a seating channel provided in a longitudinal direction in a front face thereof, and a translucent or transparent handle cover for shielding the seating channel; a decoration installed in the seating channel so as to be viewed from the outside through the handle cover; and handle holders provided at both ends of the handle bar to fix and support the handle bar at one side of a door.

Preferably, the handle bar has a cylindrical shape such that a space is formed therein.

Preferably, the handle bar includes: a handle bar body provided with hooking ribs formed to extend in parallel at both ends of a cross section thereof; and a cover base coupled with the hooking ribs of the handle bar body so as to be fastened to the handle bar body, wherein the seating channel is provided in the cover base so that the decoration and the handle cover are mounted thereto.

Preferably, cover end coupling pieces to be fastened to both ends of the cover base are formed at both ends of the handle cover, and the cover base is formed with coupling ribs corresponding to coupling holes formed in the cover end coupling pieces so that the handle cover and the cover base are coupled with each other.

Preferably, cover protrusions are formed at both longitudinal ends of the handle cover, and coupling recesses are formed at positions in the seating channel corresponding to the cover protrusions so that the cover protrusions can be seated in the coupling recesses.

Preferably, the decoration is made of a jewel or luminous body.

Preferably, each of the handle holders includes: a holder body formed with a bar seating groove in which an end of the handle bar is seated and engaged; and an end shield piece formed at an end of the holder body to shield the end of the handle bar.

Preferably, the end shield piece of the handle holder is formed with a coupling through-hole for coupling with each of end coupling pieces formed at both ends of the handle cover, and a cap is mounted to the coupling through-hole.

Preferably, the handle cover is made by injection-molding a synthetic resin, and the handle bar is made by extruding a metallic material.

According to other aspect of the present invention for achieving the objects, there is provided a door handle for a refrigerator, comprising: a handle bar having a seating channel formed in a longitudinal direction in a front face thereof, and a transparent or translucent handle cover for shielding the seating channel; a decoration installed in the seating channel so as to be viewed from the outside through the handle cover; and handle holders provided at both ends of the handle bar to fix and support the handle bar at one side of a door, wherein cover end coupling pieces are formed at both ends of the handle cover so as to extend toward the handle bar so that the cover end coupling pieces are coupled respectively with both ends of the handle bar.

Preferably, the handle bar includes: a handle bar body provided with hooking ribs formed to extend in parallel at both ends of a cross section thereof, and a cover base coupled with the hooking ribs of the handle bar body so as to be fastened to the handle bar body, wherein the seating channel is provided in the cover base so that the decoration and the handle cover are mounted thereto.

Preferably, the cover end coupling pieces of the handle cover are coupled to a coupling rib formed on the handle bar body.

Preferably, the cover end coupling pieces of the handle cover are coupled to a coupling rib formed on the cover base.

Preferably, the decoration is made of a jewel or luminous body.

Preferably, each of the handle holders includes: a holder body formed with a bar seating groove in which an end of the handle bar is seated and engaged; and an end shield piece formed at an end of the holder body to shield the end of the handle bar.

Preferably, the end shield piece of the handle holder is formed with a coupling through-hole for coupling with each of end coupling pieces formed at both ends of the handle cover, and a cap is mounted to the coupling through-hole.

According to other aspect of the present invention for achieving the objects, there is provided a door handle for a refrigerator, comprising: a handle bar including a handle bar body formed to be elongated in one direction and having an open front face, and a handle cover mounted to the open front face of the handle bar body; a decoration installed at a position on the front face of the handle bar body except a position where the handle cover is mounted; and handle holders provided at both ends of the handle bar to fix and support the handle bar at one side of a door.

Preferably, a decoration groove capable of receiving a decoration material is formed in a front face of the decoration, and a decoration cover made of a transparent or translucent material is mounted in the decoration groove of the decoration so that the interior of the decoration groove can be seen from the outside.

Preferably, the decoration material including a jewel or a luminous body is received in the decoration groove of the decoration.

Preferably, the decoration and the decoration cover are formed by injection-molding a synthetic resin, and the decoration cover contains a luminous or photoluminescence material.

Preferably, first fixing steps for mounting the handle cover are formed to face each other inside the open front face of the handle bar body, and second fixing steps for mounting the decoration are formed to face each other at portions inward with respect to the first fixing steps, wherein hook projections caught by the first fixing steps are formed to be elongated in a longitudinal direction of the handle cover at both ends of a rear face of the handle cover, and a plurality of hooks caught by the second fixing steps are formed along both ends of a rear face of the decoration.

Preferably, the handle bar body and the handle cover are formed by extruding a metallic material.

According to another aspect of the present invention for achieving the objects, there is provided a door handle for a refrigerator, comprising: handle holders coupled to a door; and a handle bar with both ends mounted to and supported by the handle holders, wherein a decoration is installed to at least one side of the handle holder and the handle bar.

Preferably, the decoration emits light and is installed inside the handle bar or the handle holders, and the handle holders and the handle bar are at least partially transparent or translucent to transmit the light from the decoration to the outside.

Preferably, the decoration is interposed between the handle holders and the handle bar, contains a luminous body therein, and is transparent or translucent to transmit light to the outside.

Preferably, the decoration has a ring shape and contains a luminous body therein.

Preferably, the decoration has a cylindrical shape so that the handle bar or the handle holders pass therethrough, and a luminous body is installed inside the decoration.

Preferably, the luminous body provided in the decoration is one selected from an LED, a lamp, a light emitting material and a fluorescent material.

Advantageous Effects

With the door handle for a refrigerator according to the present invention constructed as above, the strength of the door handle is relatively reinforced. Thus, there are advantages in that no deformation occurs upon operation of the door handle, durability thereof is improved, and various decorations can be made thereon.

Further, according to an embodiment of the present invention, components of the door handle are firmly coupled to one another. Thus, there are advantages in that the strength of the entire door handle is relatively improved and it is possible to minimize the occurrence of relative deformation between components with different properties.

Moreover, according to another embodiment of the present invention, there is an advantage in that it is possible to make various kinds of door handles with minimized design changes of their components.

In addition, according to the present invention, since a luminous body is contained in the door handle and emits light, there are advantages in that a user can easily identify the door handle even in the dark and the door handle itself can act as a light, resulting in better convenience to the user.

BEST MODE

Hereinafter, the configurations of door handles for a refrigerator according to preferred embodiments of the present invention will be described in detail with reference to the accompanying drawings.

Figure 1:
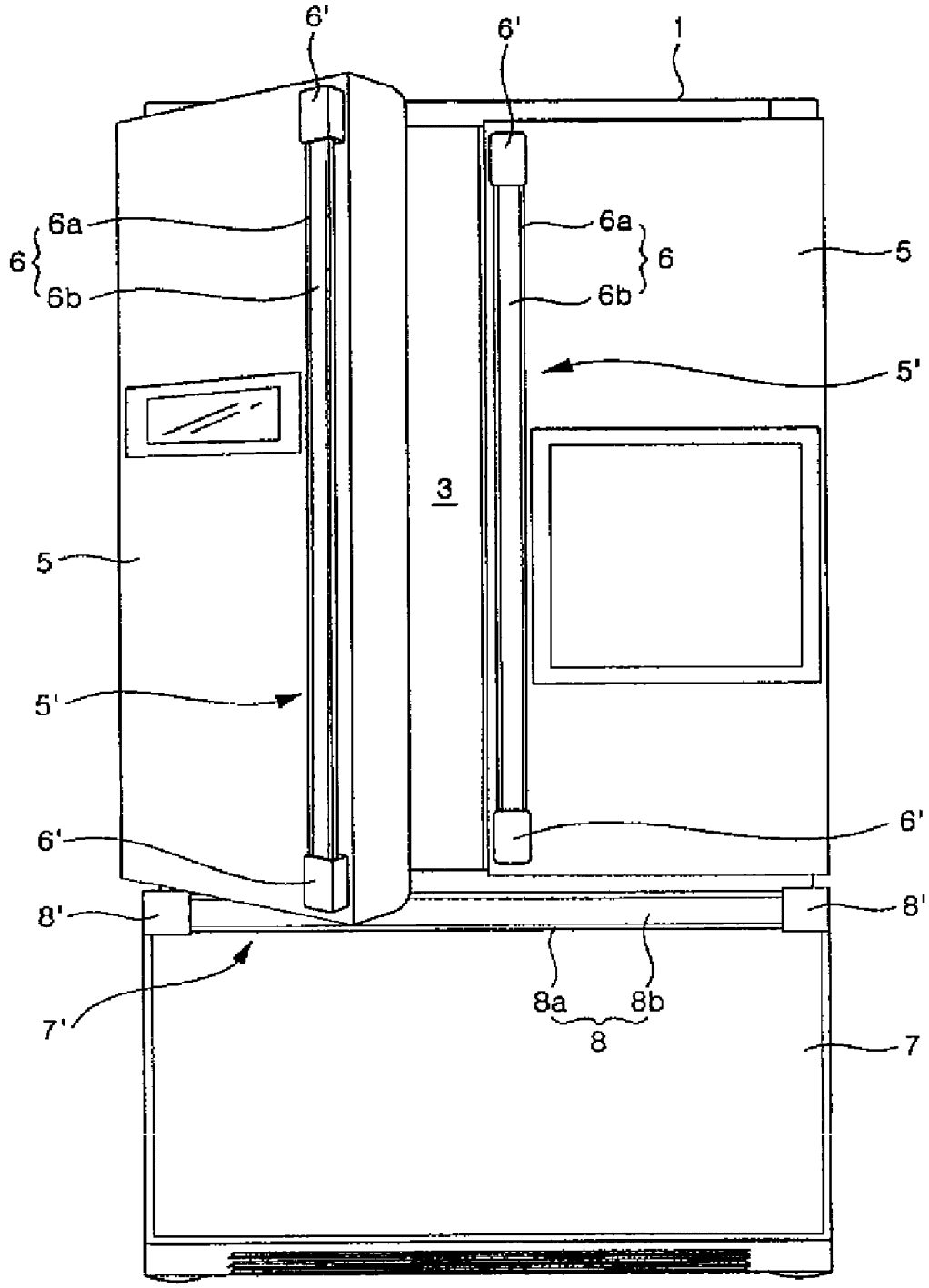
FIG. 1 is a perspective view showing the configuration of a front face of a refrigerator with a conventional door handle.
Figure 2:
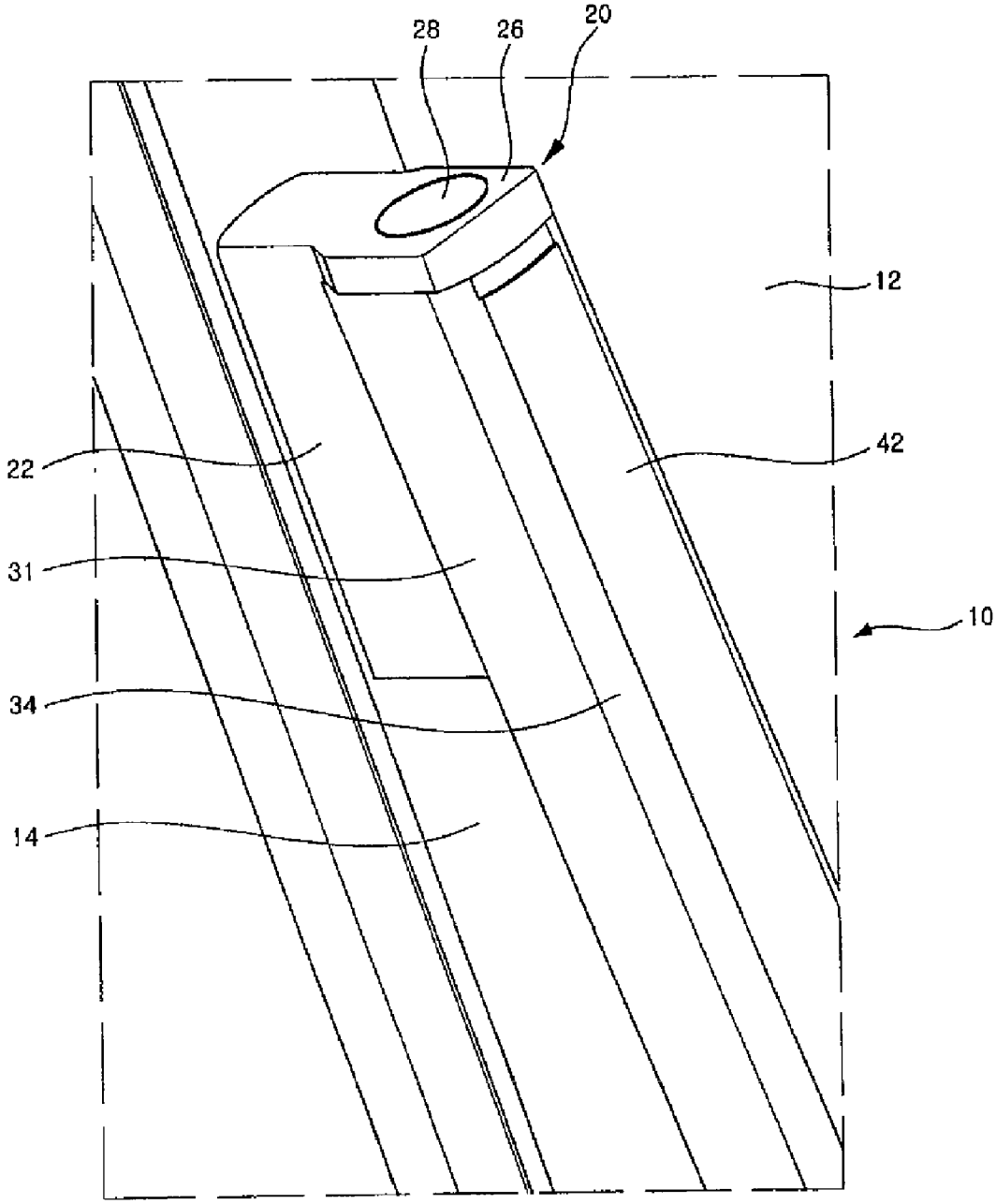
FIG. 2 is a perspective view showing major potions of a door handle for a refrigerator according to a preferred embodiment of the present invention in a state where the door handle is installed on a door.
Figure 3:
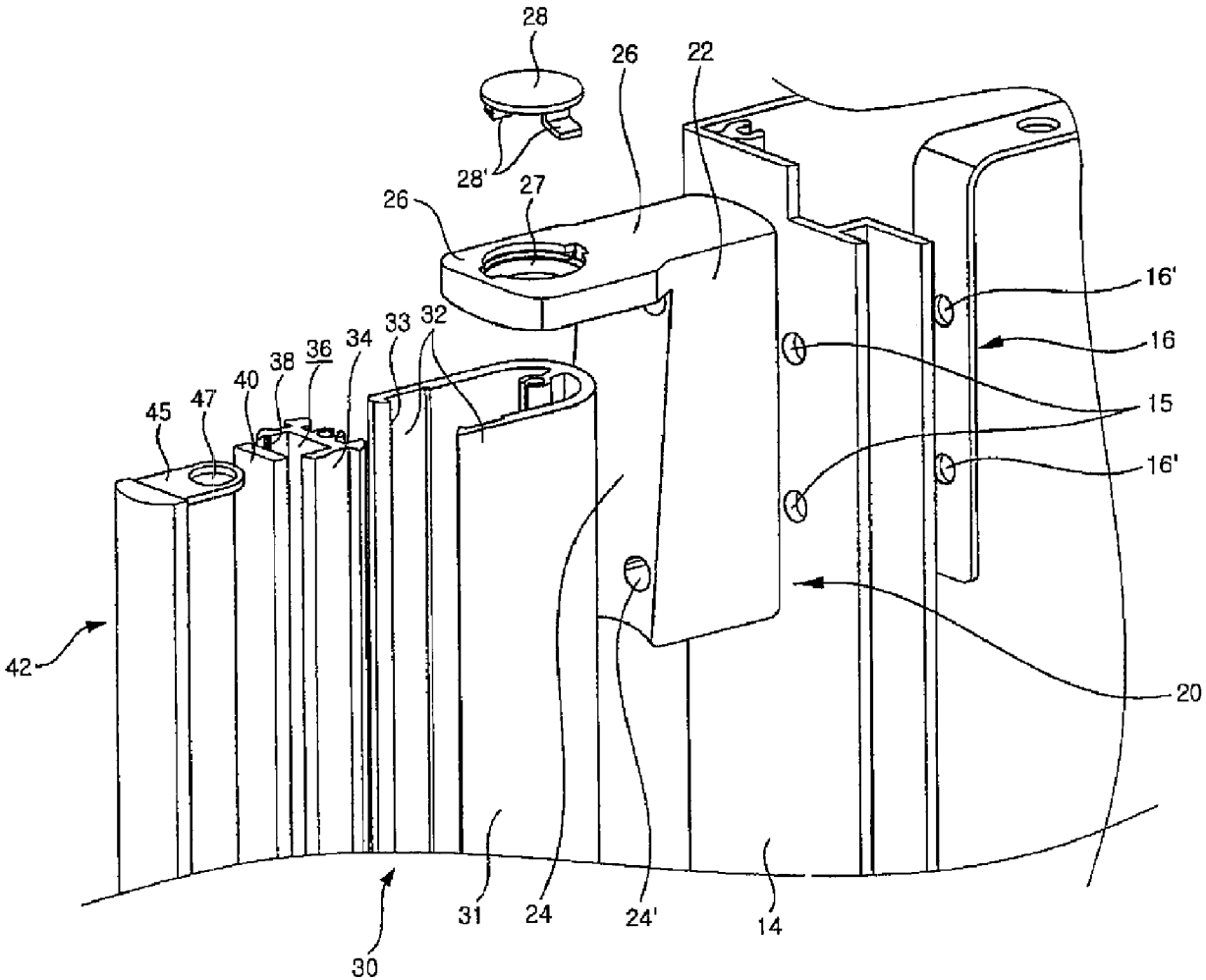
FIG. 3 is an exploded perspective view showing the configuration of the door handle of the embodiment shown in FIG. 2.
Figure 4:
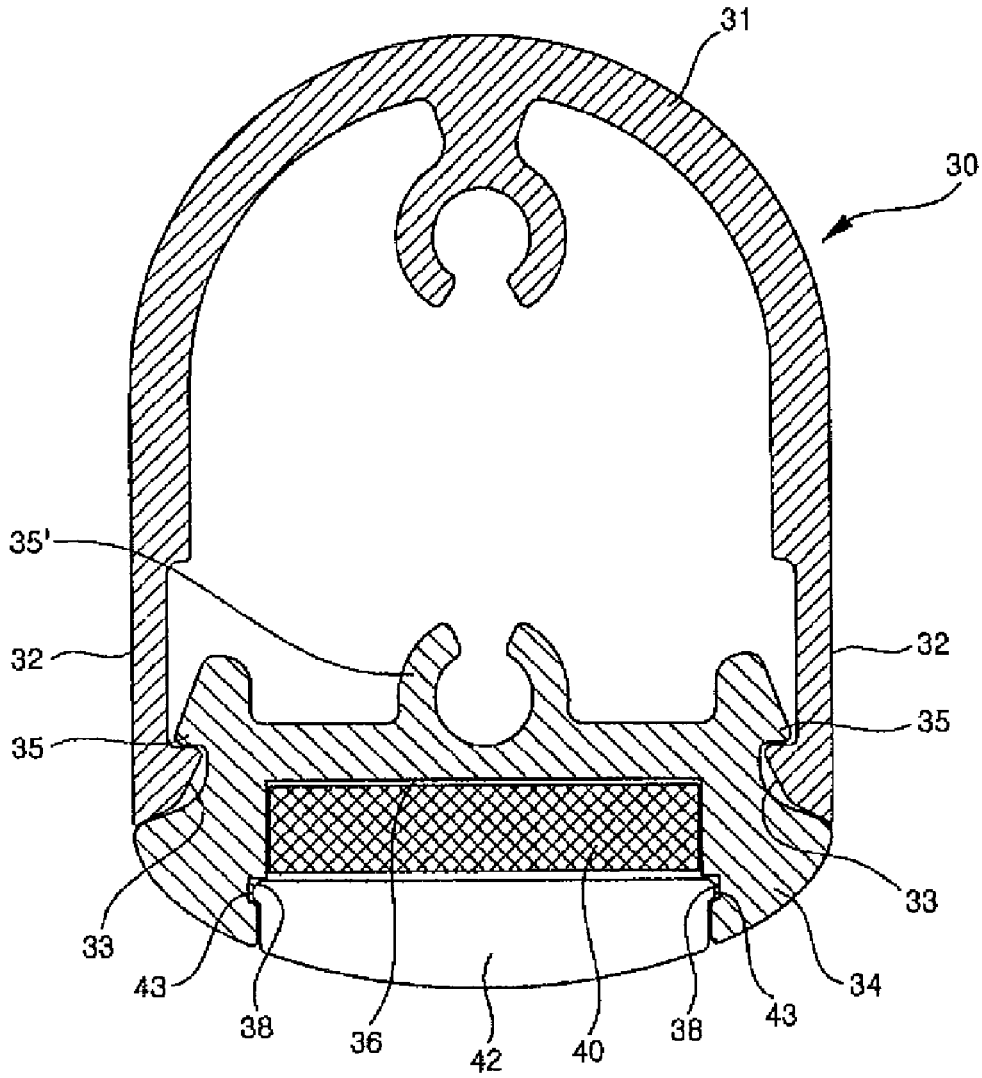
FIG. 4 is a cross-sectional view showing major portions of the door handle of the embodiment shown in FIG. 2.

Referring to FIGS. 2 to 4, a door 10 for opening or closing a storage space of a refrigerator has a front face defined by a front panel 12. Of course, an outer door may be provided inside the front panel 12 to shield an insulation layer. The door 10 has a rear face defined by a door liner (not shown).

In addition, decoration bars (not shown) define side surfaces and upper and lower surfaces of the door 10. Among the decoration bars, a side decoration bar 14 defining one side surface is constructed to shield a portion of an edge of the front panel 12. Through-holes 15 are formed in portions of the side decoration bar 14, which shields the edge of the front panel 12, in order to mount handle holders 20 that will be explained later. Mount brackets 16 with through-holes 16' at positions corresponding to the through-holes 15 are positioned on an inner surface of the side decoration bar 14. The mount brackets 16 are coupled to the side decoration bar 14 together with the handle holders 20 by means of screws (not shown).

The handle holders 20 are mounted on the portions of the side decoration bar 14, which correspond to the edge of the front panel 12 defining the front face of the door 10. Each of the handle holders 20 has a holder body 22. The holder body 22 has a substantially elongated hexahedral shape. A bar seating groove 24 is formed in the holder body 22 in a longitudinal direction. The bar seating groove 24 is formed at a side opposite to the side where the holder body 22 is coupled to the side decoration bar 14. A coupling hole 24' is formed in the bar seating groove 24 of the holder body 22. The coupling hole 24' is a portion through which a screw for coupling with a handle bar 30, which will be explained later, passes.

An end shield piece 26 is formed to protrude at an end of the holder body 22. The end shield piece 26 protrudes from the end of the holder body 22 in a direction opposite to the side decoration bar 14. A coupling through-hole 27 is formed in the end shield piece 26. The coupling through-hole 27 is used for coupling a base 34 and a handle cover 42, which will be explained later. The coupling through-hole 27 is shielded by a cap 28. That is, the cap 28 shields the coupling through-hole 27 so that coupled portions of the cover base 34 and the handle cover 42 cannot be seen from the outside. The cap 28 has a disk shape and is provided with resilient legs 28' at both side ends thereof the cap 28 such that the resilient legs can be engaged with the coupling through-hole 27 of the end shield piece 26.

The handle bar 30 includes a handle bar body 31 and the cover base 34. Depending on design conditions, the handle bar body 31 and the cover base 34 may be formed integrally with each other. Here, a predetermined space is formed in the handle bar 30. This space functions to reinforce the strength of the handle bar 30 so that the handle bar cannot to be easily deformed. That is, due to the formation of the space, the handle bar body 31 has a specific shape reinforcing the strength thereof. In particular, the strength can be reinforced by mounting the cover base 34 or the like at an entrance of the space formed in the handle bar body 31. Both ends of the handle bar 30 are coupled to and supported by the handle holders 20.

The handle bar body 31 extends in a vertical or lateral direction of the door 10, and both ends of the handle bar body 31 are coupled to the handle holders 20 and thus supported by the door 10. The handle bar body 31 may be made by extruding a metallic material. Thus, the handle bar body 31 has a uniform cross section in a longitudinal direction. In this embodiment, the handle bar body 31 has, in cross section, a semi-cylindrical shape of which both side ends linearly extend in parallel by a certain distance. That is, hooking ribs 32 are formed to extend forward at both side ends of the cross section of the handle bar body 31. A hooking protrusion 33 is formed at a front end of each of the hooking ribs 32. The hooking ribs 32 and the hooking protrusions 33 are continuously formed to be elongated in the longitudinal direction of the handle bar body 31.

The cover base 34 is engaged with the hooking ribs 32 of the handle bar body 31. The cover base 34 has the same length as the handle bar body 31 and functions to reinforce the handle bar 30 through coupling with the handle bar 30. Coupling ribs 35 caught by the hooking protrusions 33 are formed at both ends of a rear face of the cover base 34 in the longitudinal direction. Coupling ribs 35 are also formed on the cover base 34. The coupling ribs 35 are portions that are to be coupled with a cover end coupling piece 45 of the handle cover 42, which will be explained later.

A seating channel 36 is formed to be elongated in the longitudinal direction in a front face of the cover base 34. An additional decoration 40 is put into the seating channel 36. Various kinds of decorations can be used as the decoration 40. For example, decorations having colors or made of materials different from that of the handle bar body 31 or the cover base 34, or employing luminous bodies may be used to give various aesthetic senses.

In addition, a jewel such as crystal may be used for the decoration 40 so that the door handle looks more elegant. The decoration 40 may be Swarovski stone as an example.

Coupling recesses 38 are formed in the seating channel 36 of the cover base 34 at positions departing from a front face of the decoration 40. The coupling recesses 38 extend in the longitudinal direction of the cover base 34. The coupling recesses 38 are formed at opposite positions in the seating channel 36.

The handle cover 42 is installed in the seating channel 36 in which the decoration 40 has been seated. The handle cover 42 is made of a transparent material. For example, the handle cover 42 is formed by injection-molding a transparent PC material. The handle cover 42 is provided with cover protrusions 43 to be seated in the coupling recesses 38. The cover protrusions 43 are seated in the coupling recesses 38 so that the handle cover 42 can be coupled with the cover base 34.

The cover protrusions 43 are formed to be elongated in the longitudinal direction along both side ends of the handle cover 42.

The cover end coupling pieces 45 are formed at both ends of the handle cover 42. The cover end coupling pieces 45 are formed to be perpendicular to the other portions of the handle cover 42. A through-hole 47 is formed in each of the cover end coupling pieces 45. The cover end coupling pieces 45 are used for coupling thereof with the cover base 34.

Hereinafter, the operation of the door handle for a refrigerator according to the embodiment of the present invention constructed as above will be described in detail.

First, an operation for assembling the door handle of the present invention will be explained. The decoration 40 is seated in the seating channel 36 of the cover base 34. At this time, a double-sided tape or an adhesive is preferably used so that the decoration 40 cannot be easily separated from the seating channel 36.

After the decoration 40 is mounted to the cover base 34, the handle cover 42 is mounted to the cover base 34. To this end, the cover protrusions 43 of the handle cover 42 are placed in the coupling recesses 38 of the seating channel 36. When the handle cover 42 is mounted over the entire length of the cover base 34, the through-holes 47 of the cover end coupling pieces 45 are located at positions corresponding to the coupling ribs 35 of the cover base 34.

In this state, the cover base 34 is assembled to the handle bar body 31. Of course, the decoration 40 or the handle cover 42 may be mounted in the state where the cover base 34 is assembled to the handle bar body 31. The cover base 34 is coupled to the handle bar body 31 in such a manner that the coupling ribs 35 at both ends of the rear face of the cover base are caught by the hooking protrusions 33 formed on the hooking ribs 32 of the handle bar body 31. When the cover base 34 is assembled to the handle bar 30, the hooking ribs 32 are slightly elastically deformed and then restored to their original states to fix the cover base 34.

Then, the handle holders 20 are coupled to the handle bar body 31. To this end, screws passing through the coupling holes 24' formed in the bar seating grooves 24 of the handle holders 20 are fastened to the handle bar body 31. In this way, the handle bar body 31 and the handle holders 20 are coupled with each other.

The handle holders 20 are coupled to the side decoration bar 14. That is, in a state where the holder bodies 22 of the handle holders 20 are positioned on an outer side of the side decoration bar 14 and the mount brackets 16 are positioned on an inner side thereof, screws passing through the through-holes 16' of the mount brackets 16 and the through-holes 15 of the side decoration bar 14 are fastened to the holder body 22. In this way, the handle holders 20 are coupled to the side decoration bar 14.

Meanwhile, a screw is fastened to the coupling ribs 35 of the cover base 34 and the cover end coupling piece 45 through the coupling through-hole 27 of the end shield piece 26 of each of the handle holders 20. In this way, the handle holders 20, the handle bar body 31 and the handle cover 42 are coupled with one another. Then, the cap 28 is mounted in the coupling through-hole 27 of the end shield piece 26 of each of the handle holders 20 so that the cover end shield piece 45 or the like cannot be seen from the outside.

Of course, the handle holders 20 and the handle cover 42 may be directly coupled depending on design conditions. This is because the handle bar body 31 is coupled to the holder bodies 22 of the handle holders 20 by means of screws. In this case, it is not necessary to form the coupling through-hole 27 in the end shield piece 26, and to use the cap 28 as well.

When the handle holders 20 provided at the both ends of the handle bar 30 are coupled to the side decoration bar 14 in this way, the door handle is mounted to the door 10.

In this embodiment, the cover base 34 and the handle bar body 31 of the handle bar 30 are formed by extruding a metallic material, and the handle cover 42 is formed by injection-molding a synthetic resin material. Thus, there may be difference in their coefficients of thermal expansion, but a coupling state thereof is not changed according to changes in environment since the both ends of the handle cover 42 are coupled with the cover base 34 by means of the cover end coupling pieces 45.

For reference, the handle bar 30 may be formed not separately from but integrally with the handle bar body 31 and the handle cover 42 in this embodiment. However, in this case, the seating channel 36 may be formed in the front face of the handle bar 30 corresponding to the handle cover 42, the decoration 40 may be placed in the seating channel, and the seating channel 36 may be shielded by the transparent handle cover 42.

The handle cover 42 is not necessarily completely transparent and may be at least translucent or transparent.

Mode for Invention

Figure 5:
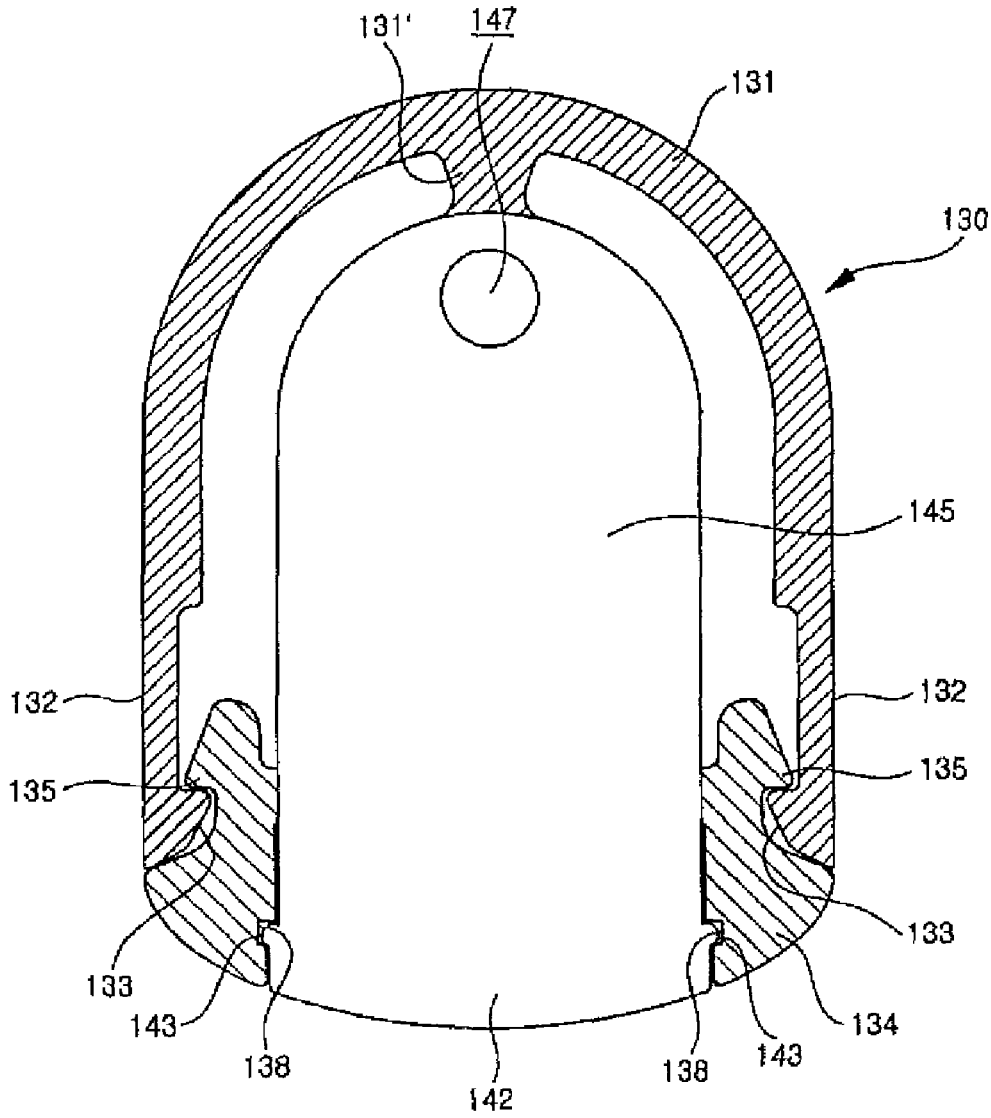
FIG. 5 is a cross-sectional view showing major portions of a door handle according to another embodiment of the present invention.
Figure 6:
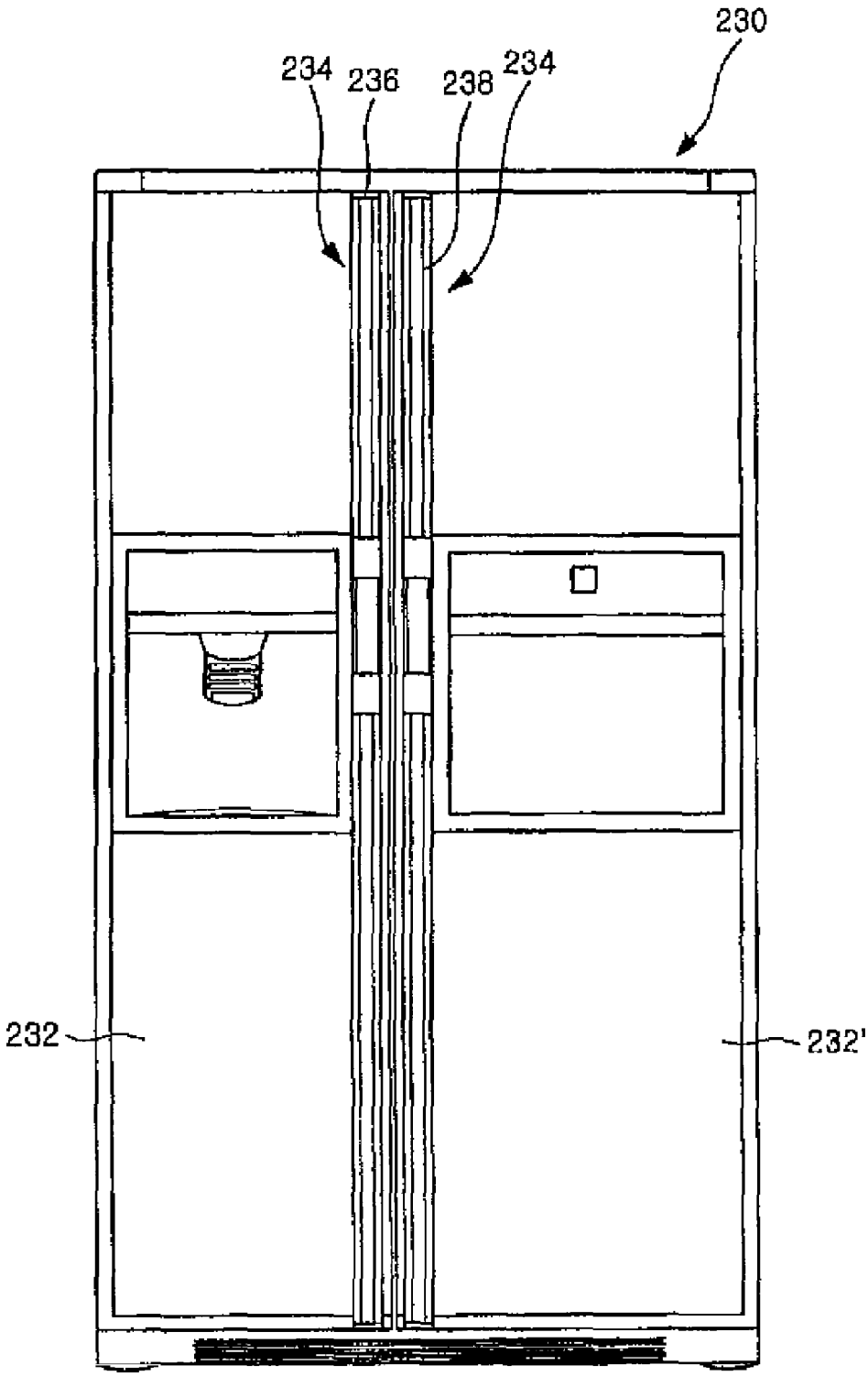
FIG. 6 is a front view showing the configuration of a front face of a refrigerator equipped with a door handle according to another embodiment of the present invention.

Meanwhile, FIG. 5 shows a door handle according to another embodiment of the present invention. For description of this embodiment, components corresponding to those of the previous embodiment described above are designated by like reference numerals but added by 100, and only different components will be described below.

In this embodiment, a coupling rib 131' is formed to be elongated in a handle bar body 131 of a handle bar 130 in a longitudinal direction of the handle bar body 131. The coupling rib 131' is used for coupling with cover end coupling pieces 145. The coupling rib 131' is formed over the entire length of the handle bar body 131. This is because the handle bar body 131 is formed by extruding a metallic material.

Hooking ribs 132 are formed in parallel at both longitudinal ends of an open portion of the handle bar body 131. Hooking protrusions 133 are formed at front ends of the hooking ribs 132 over the entire lengths of the hooking ribs 132. The hooking protrusions 133 of the hooking ribs 132 at the both ends are formed to face each other.

A cover base 134 is installed in the open portion of the handle bar body 131 while being caught by the hooking ribs 132. The cover base 134 is constructed such that hooks 135 to be caught by the hooking protrusions 133 of the hooking ribs 132 are formed on a rear side of the cover base in parallel at positions corresponding to the hooking protrusions 133.

A seating channel (not shown) is formed in a front face of the cover base 134. For example, a decoration (not shown) is mounted in the seating channel. Coupling recesses 138 are formed at an entrance of the seating channel of the cover base 134. The coupling recesses 138 are formed to be elongated in the longitudinal direction of the cover base 134.

A handle cover 142 is mounted to the cover base 134, and cover protrusions 143 are formed to be elongated at both ends of the handle cover in the longitudinal direction thereof. The cover protrusions 143 are seated in the coupling recesses 138 so that the handle cover 142 can be coupled to the cover base 134.

The cover end coupling pieces 145 are formed at both ends of the handle cover 142 to be perpendicular to the other portions of the handle cover 142. Through-holes 147 are formed in the cover end coupling pieces 145, and the through-holes 147 are formed at positions corresponding to the coupling rib 131' as well shown in FIG. 5. Thus, the cover end coupling pieces 145 are coupled to the handle bar body 131.

Since the handle cover 142 is coupled directly to the handle bar body 131 as mentioned above, the cover base 134 can be separated from the handle bar body 131 only when the handle cover 142 is separated from the handle bar body 131.

The handle door for a refrigerator according to this embodiment mentioned above is assembled in the substantially same manner as the previous embodiment. However, since the handle cover 142 is coupled to the coupling rib 131' of the handle bar body 131, the entire handle bar 130 is coupled into one unit, so that a coupling state among the handle cover 142, the cover base 134 and the handle bar body 131 is more secured as compared with the previous embodiment.

Now, a door handle according to a further embodiment of the present invention will be described with reference to FIGS. 6 to 10.

This embodiment will be explained in connection with a side-by-side type refrigerator. Doors 232 and 232' are installed at a front face of a refrigerator main body 230. The doors 232 and 232' are used for selectively opening or closing storage spaces formed in the refrigerator main body 230. A door handle 234 is installed at a front end of each of the doors 232 and 232'.

The door handle 234 includes handle holders 236 installed at upper and lower ends of a front face of each of the doors 232 and 232', and a handle bar 238 of which both ends are supported by the handle holders 236. The handle holders 236 allow the handle bar 238 to be supported while being spaced apart by a certain distance from the front face of each of the doors 232 and 232'. For reference, although the door handle 234 is vertically installed on the door in this embodiment, it may also be installed in a horizontal direction depending on the kind of a door.

The handle bar 238 includes a handle bar body 240 with a substantially U-shaped cross section. The handle bar body 240 is formed to be elongated in the longitudinal direction while its front end portion toward the front of each of the doors 232 and 232' is opened. That is, the handle bar body 240 is formed by extruding a synthetic resin or metallic material to have the same sectional area over the entire length. The handle bar body 240 is preferably made of a metallic material, for example, aluminum.

First fixing steps 242 are formed along both sides at front ends of an open portion of the handle bar body 240. The first fixing steps 242 are formed to be elongated over the entire length of the handle bar body 240. The first fixing steps 242 at the both sides are formed to face each other. Second fixing steps 244 are formed to face each other at positions inward with respect to the positions where the first fixing steps 242 are formed. The second fixing steps 244 are also formed to be elongated in the longitudinal direction of the handle bar body 240.

A coupling rib 246 for coupling with the handle holders 236 is formed in the handle bar body 240. The coupling rib 246 is formed to be elongated in the longitudinal direction of the handle bar body 240 at a portion corresponding to the center of an inner face of the handle bar body 240.

A handle cover 250 is mounted to a front end of the open portion of the handle bar body 240. In this embodiment, at least two handle covers 250 are used. Although the handle cover. 250 has a convexly curved face facing the front of each of the doors 232 and 232' in this embodiment, it is not necessarily limited thereto. The handle cover 250 is also formed by means of extrusion, and preferably made of a metallic material. For example, the handle cover 250 may be made of aluminum.

Hooks 252 to be caught by the first fixing steps 242 are formed at both ends of a rear face of the handle cover 250. The hooks 252 are formed to face in opposite directions at both ends of each of portions protruding from the rear face of the handle cover 250. The hooks 252 also extend in the longitudinal direction of the handle cover 250. A coupling rib 254 for coupling with the handle holders 236 is formed along the center of the rear face of the handle cover 250.

Meanwhile, a decoration 260 is coupled and installed together with the handle cover 250 to the handle bar body 240. The decoration 260 is mounted to a portion of the handle bar body 240 where the handle cover 250 is not mounted. As seen from FIG. 6, in this embodiment, the decoration 260 is positioned slight above a central portion of the handle bar 238. However, the position of the decoration 260 is not limited thereto. In addition, as the number of the handle covers 250 varies, the number of the decorations 260 may be changed.

The decoration 260 is formed by injection-molding a synthetic resin material. Thus, the decoration 260 can be implemented in relatively various shapes rather than the handle bar body 240 and the handle cover 250. For example, the decoration 260 may be made of synthetic resins with various colors and have various shapes since its sectional shape is not necessarily consistent as a whole.

Figure 7:
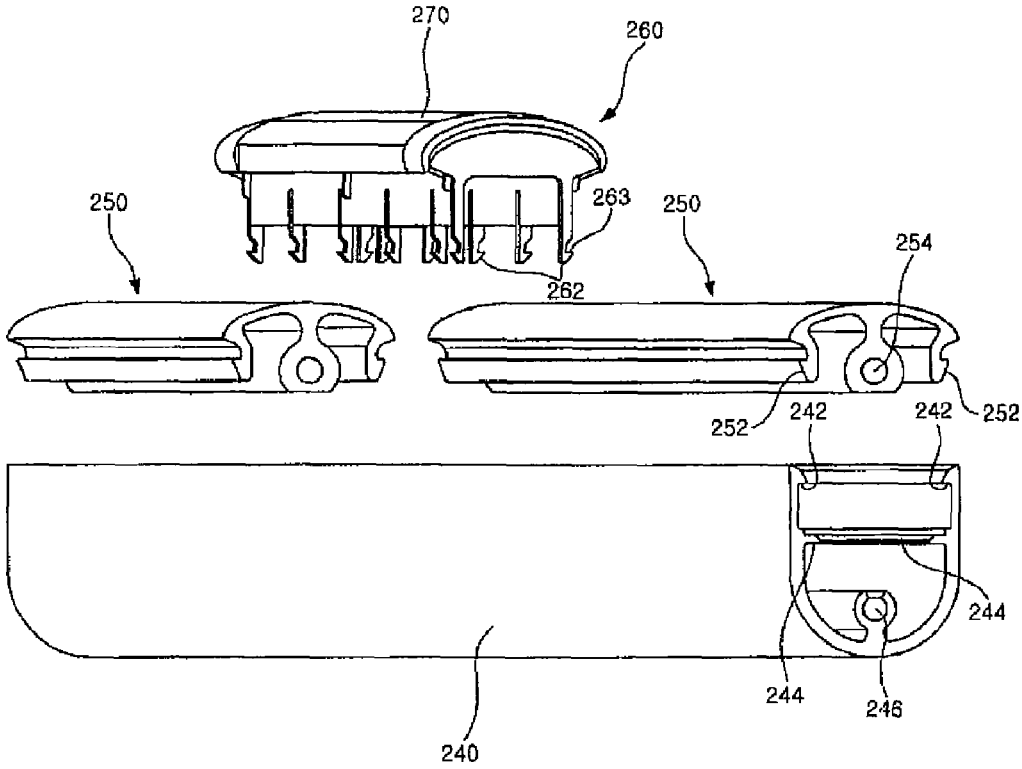
FIG. 7 is an exploded perspective view showing the configuration of the door handle of the embodiment shown in FIG. 6.
Figure 8:
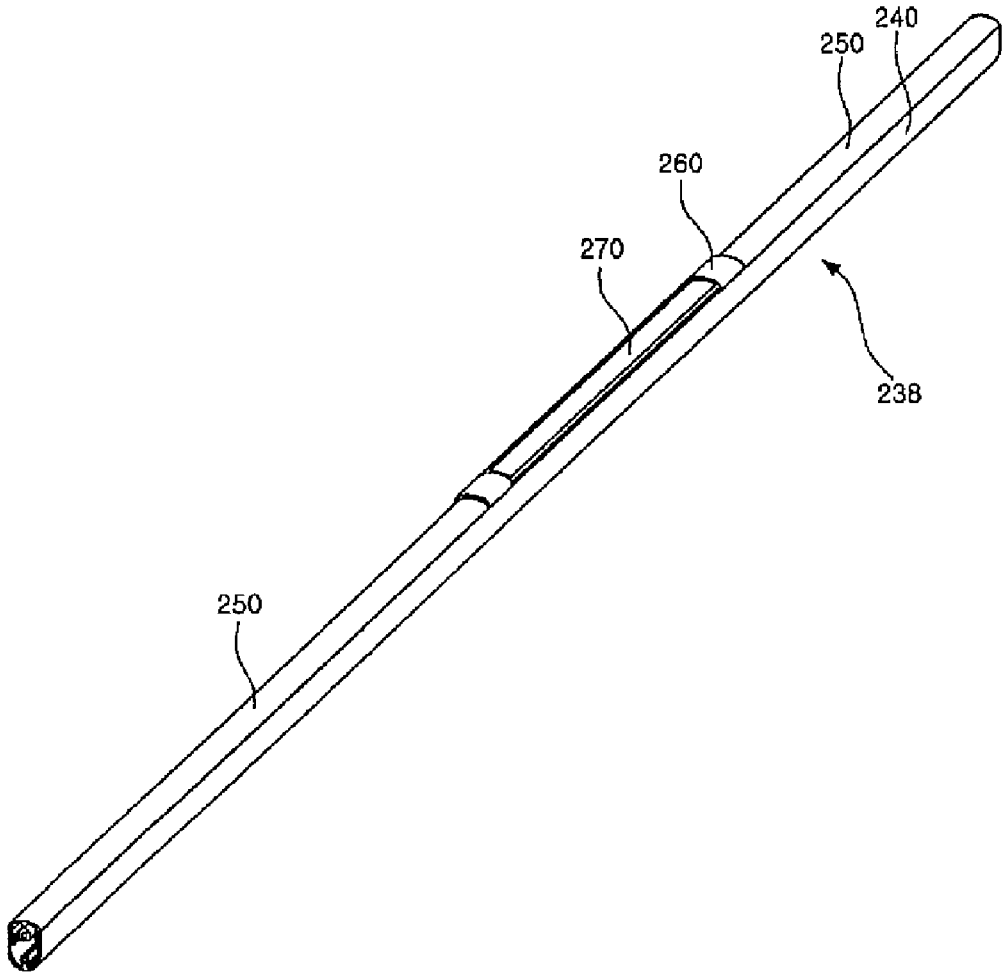
FIG. 8 is a perspective view showing the configuration of the door handle of the embodiment shown in FIG. 6.
Figure 9:
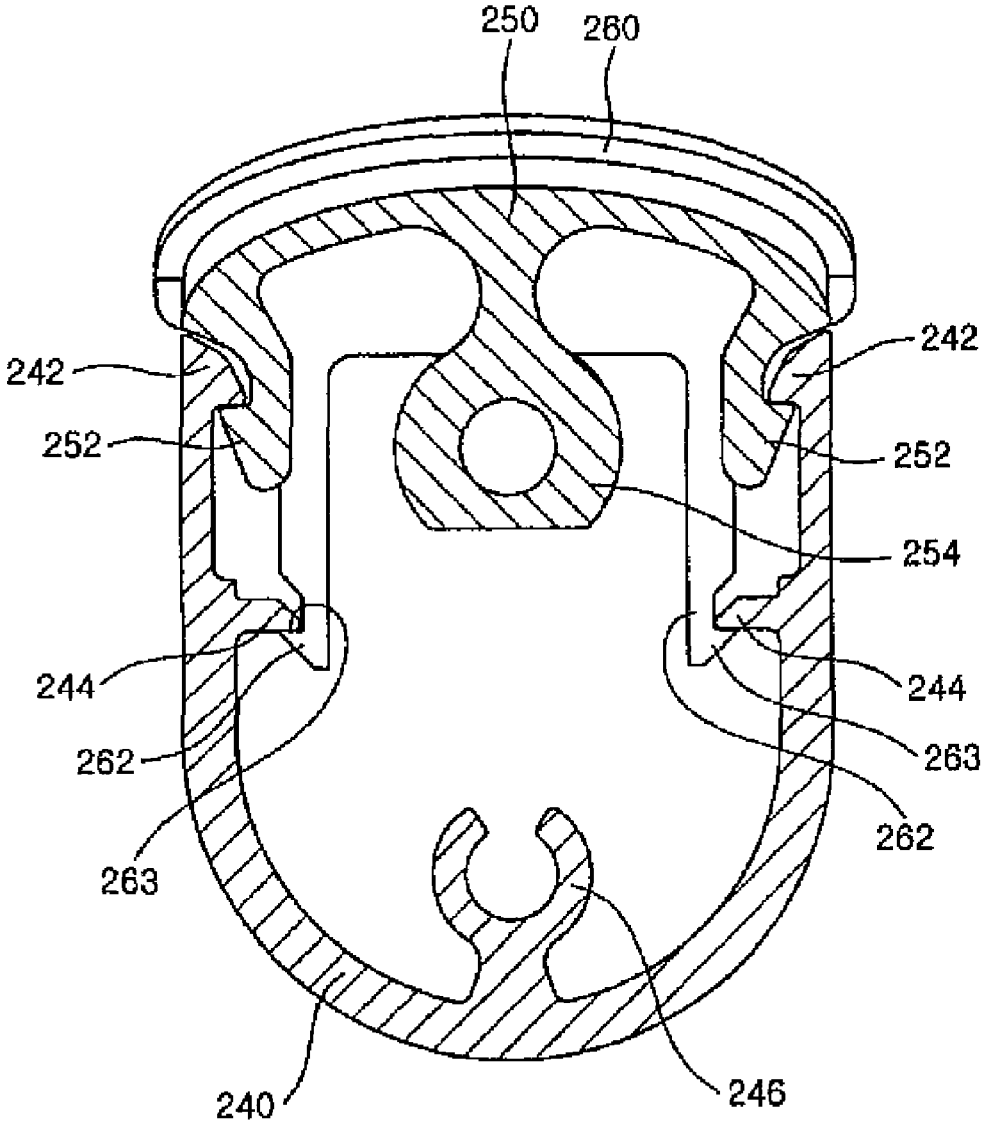
FIG. 9 is a cross-sectional view showing major portions of the door handle of the embodiment shown in FIG. 6.
Figure 10:
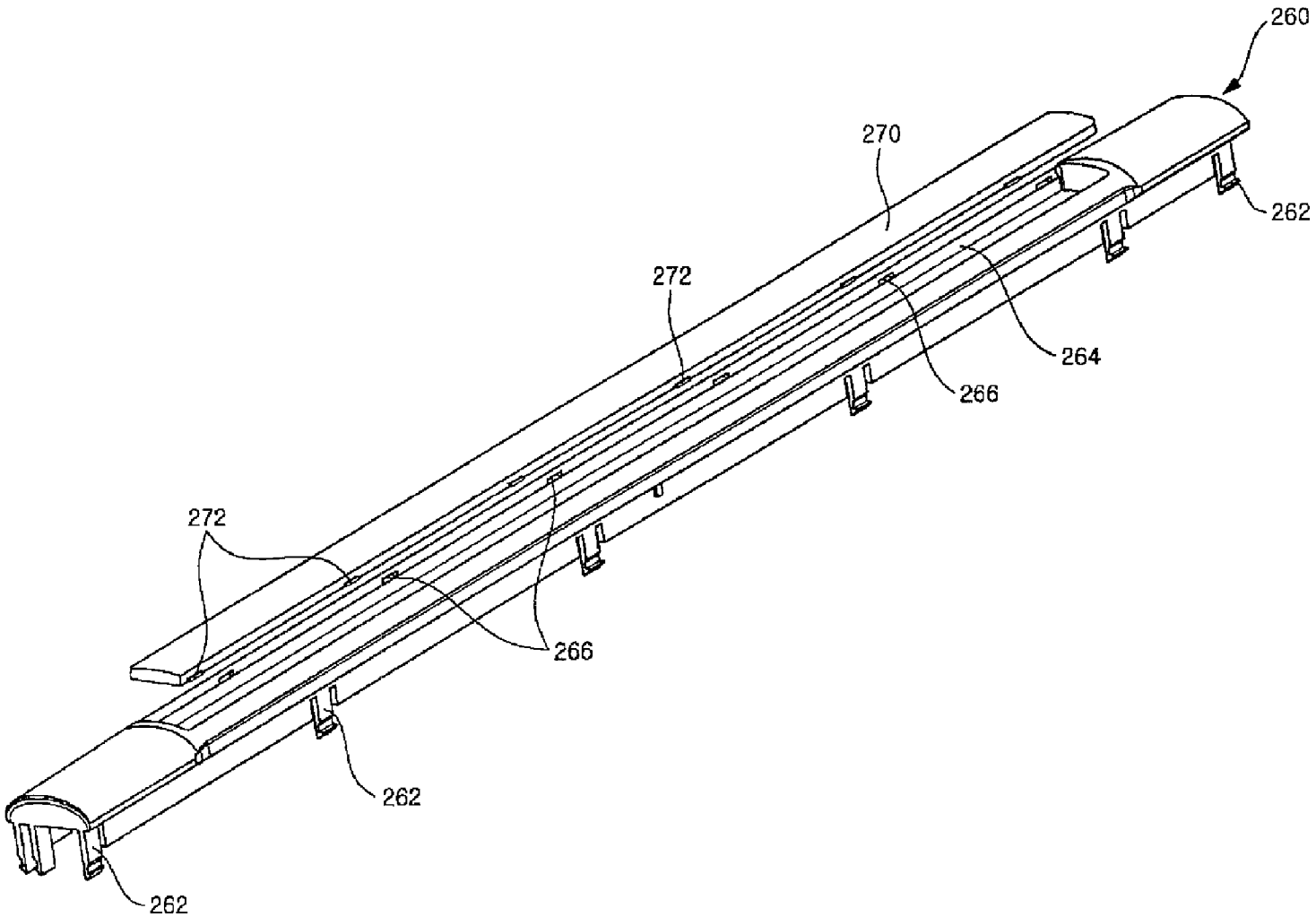
FIG. 10 is an exploded perspective view showing a decoration and a decoration cover of the door handle of the embodiment shown in FIG. 6.

In this embodiment, as shown in FIGS. 7 and 10, the decoration 260 is formed to be elongated generally in one direction but has different cross sectional shapes at respective portions contrary to the handle cover 250. As for the detailed configuration of the decoration 260, a plurality of hooks 262 are formed to extend rearward from a rear face of the decoration. The plurality of hooks 262 are formed at certain intervals along both sides of the rear face of the decoration 260. A hook projection 263 is formed at a front end of each of the hooks 262 so as to be caught by the second fixing step 244 of the handle bar body 240. The hooks 262 may be elastically deformed relatively more in view of their material and shape.

An open decoration groove 264 is formed in a front face of the decoration 260. The decoration groove 264 is formed to be depressed in the front face of the decoration 260. A plurality of coupling recesses 266 are formed around a periphery of the decoration groove 264.

A decoration cover 270 is mounted in the decoration groove 264 of the decoration 260. The decoration cover 270 may also be made by means of injection molding and is made of a synthetic resin material. In particular, the decoration cover 270 is preferably made of a transparent material. This is to allow an additional decoration installed in the decoration groove 264 to be seen from the outside. Of course, the decoration cover 270 may have a specific color and design to serve as a decoration by itself.

The decoration cover 270 is provided with coupling protrusions 272 at positions corresponding to the coupling recesses 266 of the decoration groove 264. As the coupling protrusions 272 are seated in the coupling recesses 266, the decoration cover 270 is fixed to the decoration 260 while being seated in the decoration groove 264. In this state, a user cannot arbitrarily separate the decoration cover 270 from the decoration 260.

Hereinafter, the operation of the door handle for a refrigerator according to this embodiment constructed as above will be described in detail.

First, a process of manufacturing the handle bar 238 will be explained. The handle bar body 240 and the handle cover 250 are made by means of extrusion. Of course, additional processing may be performed on outer surfaces of the handle bar body 240 and the handle cover 250 so as to have appearances with desired colors or patterns.

In addition, the decoration 260 and the decoration cover 270 are made by means of injection molding. The decoration 260 may have different colors and shapes by properly selecting a material in the injection molding process and designing a mold for injection molding into a desired shape. In fact, injection molding allows more various colors and shapes rather than extrusion. Thus, the decoration 260 and the decoration cover 270 may have various colors and shapes.

Then, the handle cover 250 is mounted to the handle bar body 240. That is, the handle cover 250 is mounted to the handle bar body 240 in such a manner that the hooks 252 of the handle cover 250 are caught by the first fixing steps 242 of the handle bar body 240. Here, when the handle cover 250 is mounted to the handle bar body 240, elastic deformation of the front ends of the open portion of the handle bar body 240 and the rearward protruding portions of the handle cover 250 are used.

In this embodiment, two handle covers 250 are used and their lengths are changed according to the installation position of the decoration 260. That is, referring to FIG. 6, the handle cover 250 provided at an upper end of the handle bar body 240 is relatively shorter than that provided at a lower end thereof in this embodiment.

After each of the handle covers 250 is mounted at a desired position on the handle bar body 240, the decoration 260 is mounted at a remaining position. At this time, the hook projections 263 of the hooks 262 of the decoration 260 are caught by the second fixing steps 244 of the handle bar body 240. Such a mounting operation of the decoration 260 uses elastic deformation of the hooks 262.

Meanwhile, the decoration cover 270 is mounted in the decoration groove 264 of the decoration 260. If the decoration cover 270 is made of a transparent material, a user may see the interior of the decoration groove 264. That is, since decorations contained in the decoration groove 264 can be seen from the outside, the handle bar 238 can have a more beautiful appearance.

For reference, various decoration materials such as jewels, luminous bodies or objects with specific colors may be placed in the decoration groove 264.

The handle bar 238 constructed as above in this embodiment is mounted to each of the doors 232 and 232' by being coupled to the handle holders 236 mounted to each of the doors 232 and 232' using the coupling ribs 246 and 254. When the handle bar 238 is mounted to each of the doors 232 and 232' using the handle holders 236 as mentioned above, a user can open or close each of the doors 232 and 232' while gripping the handle bar 238 with his/her hand.

Figure 11:
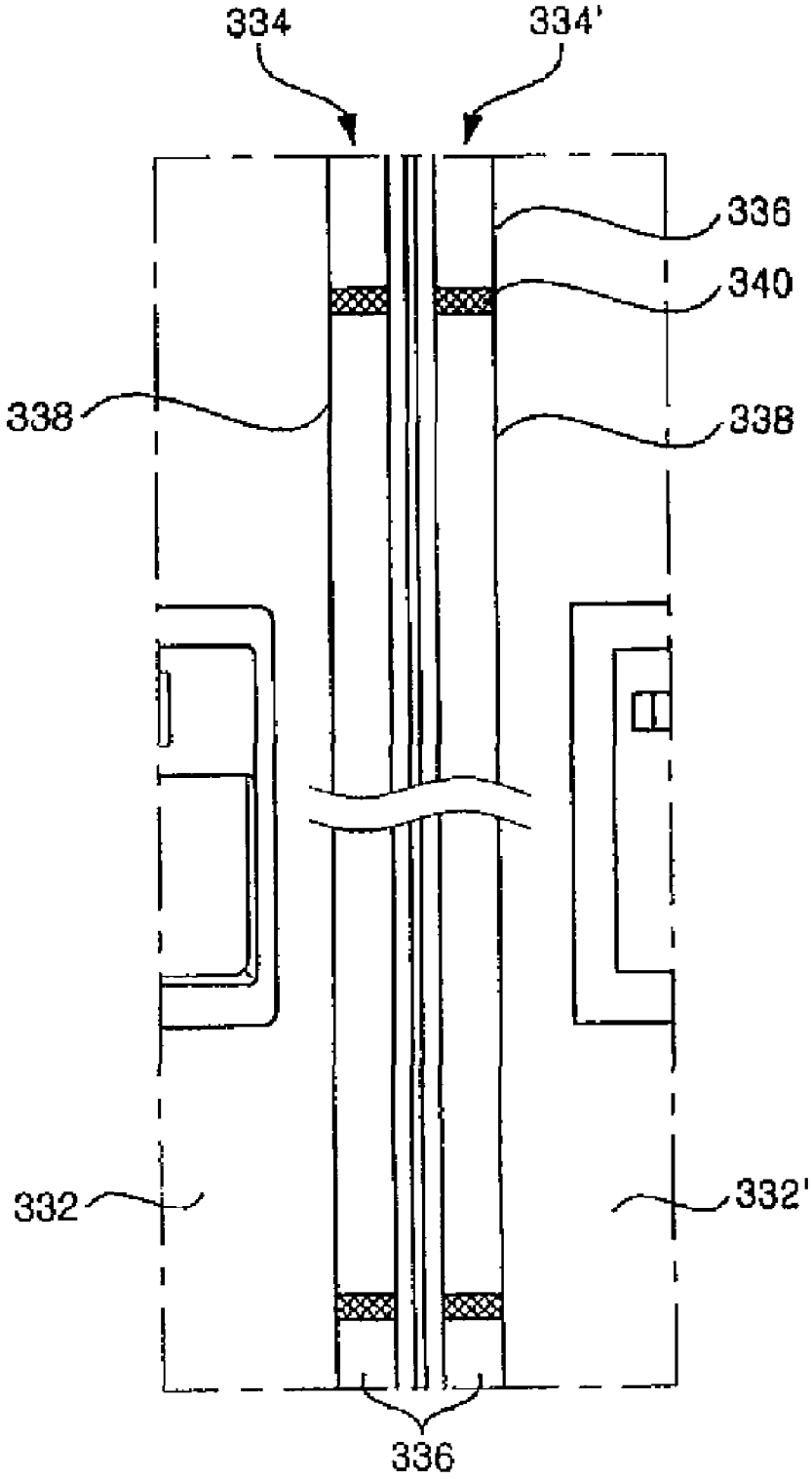
FIG. 11 is a partial front view showing that a door handle according to a further embodiment of the present invention is installed on a refrigerator door.

Now, a door handle according to a still further embodiment of the present invention will be described with reference to FIG. 11. Referring to FIG. 11, door handles 334 and 334' are installed to doors 332 and 332' mounted to a refrigerator main body, respectively. The door handles 334 and 334' serve as portions to which a user applies forces to open or close the doors 332 and 332'.

Each of the door handles 334 and 334' includes handle holders 336 coupled to each of the doors 332 and 332', and a handle bar 38 of which both ends are coupled to the handle holders 336. The handle holders 336 and the handle bar 338 may be constructed similarly to those of the previous embodiments.

In this embodiment, a decoration 340 is contained at any one side of each of the door handles 334 and 334', and the decoration 340 may be, for example, a luminous body. That is, a luminous body such as an LED or a lamp that emits light using supplied power, or a noctilucent or fluorescent substance is installed at one side of each of the door handles 334 and 334'.

As the decoration 340 in this embodiment, the luminous body may be installed at a side of the interior of the handle holder 336. In a case where the luminous body is installed in the handle holder 336, at least a part of the handle holder 336 should be made of a light transmission material so that light can be emitted to the outside. For example, if an LED or the like mentioned above is installed in the handle holder 336 and an end of the handle holder 336 (adjacent to the handle bar 338) is partially made of a light transmission material, light generated from the inner LED can be emitted outward through the part of the handle holder 336.

Alternatively, the luminous body may also be installed in the handle bar 338. Even in a case where a luminous body such as an LED is mounted inside the handle bar 338, at least a part of the handle bar 338 should be made of a light transmission material. Otherwise, it will be apparent that the entire handle bar 338 is made of a light transmission material.

As another example, luminous bodies such as LEDs may be mounted at connections between the handle bar 338 and the handle holders 336. That is, as shown in FIG. 11, the decorations 340 are interposed between the handle holders 336 and the handle bar 338. The decoration 340 is formed to have the same sectional shape as the handle bar 338, for example a circular section, and have a luminous body such as an LED or lamp therein. Alternatively, the decoration 340 may be made of a material containing a noctilucent substance or be coated with a noctilucent substance so as to emit light in the dark. Otherwise, the decoration 340 may be made of a photoluminescence material capable of absorbing light during a bright time but emitting light in the dark.

The decorations 340 are installed to be interposed between the handle bar 338 and the handle holders 336. For example, the decoration 340 may be formed in a ring shape and have a luminous body such as LED or lamp contained therein. Alternatively, the decoration 340 may be made to have a cylindrical shape and to be interposed between the handle bar 338 and each of the handle holders 336. If the decoration 340 is formed in a cylindrical shape, the handle bar 338 and the handle holders 336 are connected and supported while passing through the interior of the decoration 340, and it will be apparent that the luminous body such as an LED or lamp should be installed not to interfere with the handle bar 338 and the handle holders 336.

If the decoration 340 is made of a material capable of emitting light in this embodiment, a user can easily open or close the doors 332 and 332' of the refrigerator even in the dark. In addition, such a decoration 340 may substantially have the function of illumination in a kitchen. That is, when coming to the kitchen at night, the user can move in a very convenient way due to light from the luminous body. Further, if an LED or lamp is used as the luminous body, it is preferably turned on or off using an additional switching device.

Meanwhile, the decoration 340 of this embodiment described above may be considered as the cover base 34 or 134 and the decoration 260 of the previous embodiments. Thus, the cover base 34 or 134 and the decoration 260 (or the decoration cover 270) themselves may be made of a luminous or photoluminescence material like the decoration 340.

It will be apparent that various changes and modifications may be made by those skilled in the art within the basic technical spirit of the invention described above, and the scope of the present invention should be construed based on the appended claims.

Industrial Applicability

The door handle for a refrigerator according to the present invention described above can be applied variously to a door for opening or closing a refrigerating chamber or a freezing chamber in a refrigerator having a refrigerating chamber provided at an upper portion and a freezing chamber at a lower portion or a refrigerator having a refrigerating chamber and a freezing chamber in parallel.

The invention claimed is:

1. A door handle for a refrigerator, comprising:

a handle bar body having a pair of side walls;

a pair of hooking ribs, one of the pair of hooking ribs extending inwardly from each handle bar body side wall;

a cover base comprising a pair of hooks extending outwardly from each other, the hooks coupled to a front of the handle bar body by the pair of hooking ribs;

a seating channel formed in the cover base, the seating channel having a bottom wall and a pair of side walls;

a decoration retained in the seating channel; and a handle cover retained in the seating channel, the handle cover allowing the decoration to be visible.

2. The door handle as claimed in claim 1, wherein the handle bar body has a U shaped cross section and is hollow.

3. The door handle as claimed in claim 1, wherein cover end coupling pieces extend from both ends of the handle cover and extend over the decoration and cover base.

4. The door handle as claimed in claim 3, wherein cover protrusions extend from sides of the handle cover, and coupling recesses are formed in the seating channel, the cover protrusions engaging the coupling recesses.

5. The door handle as claimed in claim 1, wherein the decoration is made of a jewel or luminous body.

6. The door handle as claimed in claim 1, further comprising a handle holder at each end of the handle bar body, wherein each handle holder comprises:

a holder body formed with a bar seating groove in which an end of the handle bar is seated and engaged; and an end shield piece formed at an end of the holder body to shield the end of the handle bar.

7. The door handle as claimed in claim 6, wherein the end shield piece of the handle holder is formed with a coupling through-hole for coupling with cover end coupling pieces extending from each end of the handle cover.

8. The door handle as claimed in claim 1, wherein the handle cover is made by injection-molding a synthetic resin, and the handle bar is made by extruding a metallic material.

9. The door handle as claimed in claim 1, wherein the handle cover is transparent.

10. The door handle as claimed in claim 1, further comprising a coupling rib extending outwardly from each side of the cover base to secure the cover base to the handle bar body.

11. The door handle of claim 1, wherein the handle bar body has a U-shaped cross section forming a rear surface and two sides to define a hollow interior, the cover base extending between ends of the handle bar body sides.

* * * * *